United States Patent [19]

Juros

[11] Patent Number: 4,918,815

[45] Date of Patent: Apr. 24, 1990

[54] MULTI-LINK CUTTING TOOL

[76] Inventor: Karel B. F. Juros, 705 Hillwood Dr., Statesboro, Ga. 30458

[21] Appl. No.: 294,450

[22] Filed: Jan. 9, 1989

[51] Int. Cl.[5] ..... B26B 17/00; B26B 17/02; B26B 17/04

[52] U.S. Cl. ..... 30/191; 30/181; 30/192

[58] Field of Search ..... 30/181, 186, 187, 190, 30/191, 192, 184, 242, 245, 251, 252

[56] References Cited

U.S. PATENT DOCUMENTS

| | | | |
|---|---|---|---|
| 15,625 | 3/1902 | Weibezahl | 30/191 |
| 710,182 | 9/1902 | Carolus | 30/192 |
| 1,285,292 | 11/1918 | McMahon | 30/181 |
| 1,401,546 | 12/1921 | Mae | 30/191 |
| 1,640,723 | 8/1927 | Ryan | 30/191 |
| 1,910,839 | 5/1933 | Jensen | 30/191 |
| 1,924,845 | 8/1933 | Edwards | 30/191 |
| 2,341,654 | 2/1944 | Richter | 30/192 |
| 3,340,611 | 9/1967 | Lauck | 30/192 |

*Primary Examiner*—Douglas D. Watts
*Assistant Examiner*—Paul M. Heyrana, Sr.
*Attorney, Agent, or Firm*—Kenyon & Kenyon

[57] ABSTRACT

A multi-link cutting tool used to cut wire, pipe, cable, tube, chain and the like. The cutting tool utilizes a multi-link connecting linkage between the cutter head and the handles to increase the leverage obtained at the cutting edge. As a result of the connecting linkage, a lower force is required at the handles since they operate through a greater distance. With this multi-link connecting mechanism, a smaller and more powerful cutting tool can be made.

13 Claims, 1 Drawing Sheet

MULTI-LINK CUTTING TOOL

FIELD OF THE INVENTION

The present invention relates to a cutting tool of the type used to cut a variety of materials such as wire, cable, pipe, tube, chain and the like. More particularly it relates to a linkage used in a cutting tool to increase the leverage obtained at the cutting edge.

BACKGROUND OF THE INVENTION

Cutting tools typically have a cutter head with two jaws each of which is provided with a cutting edge and each of which is attached, typically by a bolt, to its own handle. The jaws are positioned in an opposing relationship to each other and are held together in this position by straps, usually metal straps, located on the top and bottom of the jaws. The straps are bolted to the jaws, and lockplates, also usually of metal, are normally mounted over the straps and are also bolted to the jaws. Typically one bolt is used for each jaw to hold the straps and the lockplates in place on both sides. This bolt passes through a hole in the jaw. In operation, pressure on the handles of the cutting tool which are connected to the jaws causes them to turn around the bolts therethrough such that each jaw pivots around the axis through the center of its bolt. Thus, the jaws are rotated in opposite directions around separate centers of motion.

A disadvantage of this cutting tool is that the handles cannot be spread as far apart as one would like. Thus, when a wire or cable is cut, the arc through which a handle moves is only about 25°. As a result, a greater force is required on the handle to receive the same total leverage at the cutting edge. Total leverage is defined as the ratio of the force at the cutting edge to the force at the end of the handle.

It would be desirable, therefore, if there was a cutting tool which overcame the disadvantages of existing cutting tools and enabled the user to exert less force on the handle but through a greater distance to achieve the total leverage necessary to cut the wire.

SUMMARY OF THE INVENTION

Generally, the present invention provides a smaller and more powerful cutting tool by using a connecting linkage for effecting the relative movement between the jaw members caused by the forces exerted on the handles of the cutting tool. The present invention comprises a pair of handles connected to a cutter head subassembly by a connecting linkage. Preferably, the cutter head subassembly is a concentric cutter head such as is described in my co-pending patent application entitled "Concentric Cutter Head" Ser. No. 07/284,521 filed Dec. 15, 1988, the disclosure of which is incorporated herein by reference as if set forth in full. Preferably, the handles are each held in position by a fastening means such that they pivot about the center of the concentric cutter head.

The connecting linkage comprises four connecting members or links. A first link at one end is connected eccentrically to the first handle and at the other end to a pivot pin. Similarly, a second link at one end is connected eccentrically to the second handle and at the other end to the same pivot pin as the first link. A third link connects the pivot pin with the end of the first jaw member which is away from the cutting edge. Similarly, the fourth link connects the pivot pin with the end of the second jaw member which is away from the cutting edge. The four links are all nonrotatably fixed at one end to either the handle or the jaw member to which they are attached but can pivot about the pivot pin to which the other ends are attached. Preferably, a fifth link and sixth link are connected in parallel with the third link and the fourth link, respectively, to provide greater structural stability when the connecting linkage is transmitting the force on the handles to the cutting edges. The fifth and sixth links are connected to the same parts as the third and fourth links, respectively. In operation, the opposing movement of the handles causes a push-pull movement of the pivot pin along the longitudinal axis of the cutting tool which opens and closes the jaw members.

Other details, objects and advantages of the present invention will become more readily apparent from the following description of a presently preferred embodiment thereof.

BRIEF DESCRIPTION OF THE DRAWINGS

In the accompanying drawings, a preferred embodiment of the present invention is illustrated by way of example only, wherein.

DESCRIPTION OF PREFERRED EMBODIMENT

Figure 1:
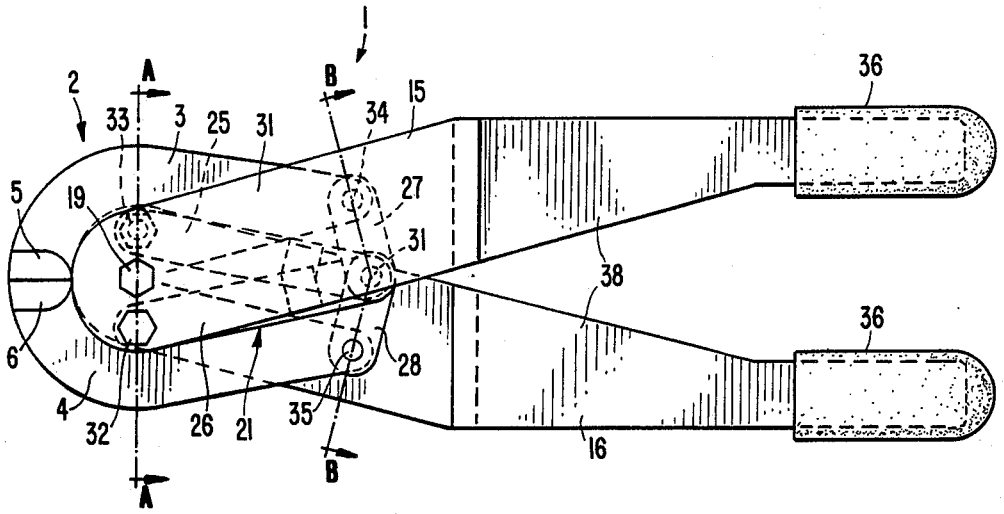
FIG. 1 is a plan elevation showing a cutting tool of the present invention.
Figure 3:
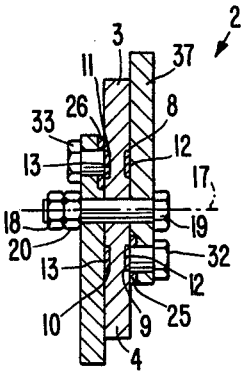
FIG. 3 is a sectional view taken on the line A—A in FIG. 1 and shows the attachment of the connecting linkage to the cutter head.

FIG. 1 shows a multi-link cutting tool 1 having a cutter head subassembly 2 comprising a first and second jaw members 3 and 4 assembled such that cutting edges 5 and 6 are in an opposed relationship. Preferably, the cutter head subassembly is a concentric cutter head as disclosed in my co-pending patent application mentioned earlier. The concentric nature of the cutter head subassembly 2 can also be seen in the cross section shown in FIG. 3. The jaw members 3 and 4 are each provided with curved slots 8, 9, 10 and 11 in which curved bearing members 12 and 13 are housed.

The multi-link cutting tool 1 has a first handle 15 and a second handle 16. Preferably, handles 15 and 16 are superimposed over the cutter head subassembly 2 as shown in FIG. 1 and are held in position with respect to jaw members 3 and 4 by a fastening means such that the handles and the jaw members all may be rotated about a common center line 17. Preferably, the fastening means comprises a nut 18, bolt 19 and washer 20.

Connecting handles 15 and 16 to cutter head subassembly 2 is a multi-link connecting linkage 21. Preferably, the connecting linkage comprises six connecting members or links 25, 26, 27, 28, 29 and 30. One end of link 25 is connected eccentrically to one end of handle 15. The other end of link 25 is connected to a pivot pin 31. Similarly, one end of link 26 is connected eccentrically to one end of handle 16. The other end of link 26 is connected to pivot pin 31. The eccentric connections can clearly be seen in FIG. 3 and are accomplished by screws 32 and 33. Two pairs of links 27,29 and 28,30 connect the pivot pin 31 with the ends of jaw members 3 and 4 which are opposite cutting edges 5 and 6. Preferably, links 27 and 29 are parallel to and spaced apart from each other, and are attached to jaw member 3 by a pin 34. Similarly, links 28 and 30 are also parallel to and spaced apart from each other and are attached to jaw member 4 by a pin 35.

Figure 2:
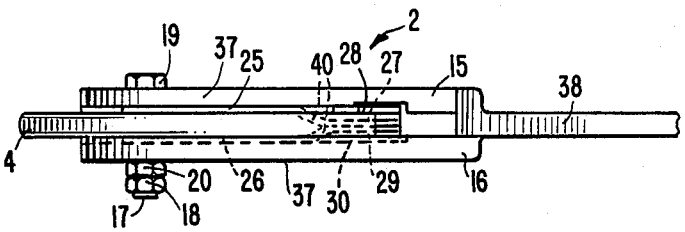
FIG. 2 is a side elevation of that portion of the cutting tool shown in FIG. 1 containing the cutter head subassembly and the connecting linkage.

As shown in FIGS. 1 and 2, handles 15 and 16 preferably each comprise three portions. At one end is a handle grip 36 while at the other end is a first flat portion 37 which is held in a fixed relationship with cutter head subassembly 2 such that it rotates around center line 17. Connected between first flat portion 37 and handle grip 36 is a second flat portion 38 which is stepped such that the second flat portion 38 of handle 15 and the second flat portion 38 of handle 16 lie in the same plane. This can be seen more clearly in FIG. 2 and facilitates the operation of the cutting tool.

Figure 4:
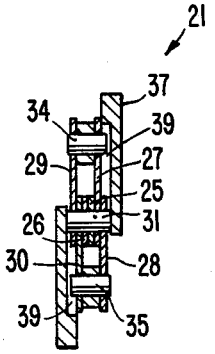
FIG. 4 is a sectional view taken on the line B—B in FIG. 1 and shows the connecting linkage.

The first flat portion 37 of both handles 15 and 16 preferably has a groove 39 as shown in FIG. 4 which can accommodate a portion of the connecting linkage. Similarly, a second groove can be cut in the first flat portion of handles 15 and 16 to accommodate another portion of the connecting linkage, namely, links 25 and 26. Preferably, connecting links 25 and 26 are each comprised of a first flat portion connected to the handles 15 and 16 and a second curved portion 40 (see FIG. 2) which facilitates the connection to the pivot pin 31. Links 25 and 26 are longer than links 27, 28, 29 and 30. By varying the ratio of the size of the links, the force applied at the cutting edges can be varied.

The linkage mechanism of the present invention increases the leverage and power one obtains at the cutting edges 5 and 6. The leverage of the cutting tool varies depending on how far the handles can be moved. With the present invention, each handle can be moved through an arc of at least 40° for a typical thickness of cable. This enables one to exert a force on the handles through a greater distance resulting in a greater total leverage for the cutting tool. The increased leverage is often 30% or more with the present invention. Moreover, one can obtain the same total leverage with less force being exerted at the handles since the force can act through a greater distance.

Another advantage of the present invention is that many of the parts are identical. For example, handles 15 and 16, jaw members 3 and 4, lines 25 and 26, links 27, 28, 29 and 30. This greatly simplifies the manufacturing process.

While a presently preferred embodiment of practicing the invention has been shown and described with particularity in connection with the accompanying drawings, the invention may otherwise be embodied within the scope of the following claims.

What is claimed is:

1. A multi-link cutting tool comprising: a concentric-cutter head; a first and second handle, each of which is held in position and pivots about the center of the concentric cutter head; and a connecting linkage between each handle and the concentric cutter head comprising: a first link connecting the first handle and a pivot pin; a second link connecting the second handle and the pivot pin; a third link connecting the pivot pin and a first jaw member of the concentric cutter head; and a fourth link connecting the pivot pin and a second jaw member of the concentric cutter head.

2. A multi-link cutting tool as described in claim 1 wherein the first link is connected eccentrically to the first handle near the center of the concentric cutter head and the second link is connected eccentrically to the second handle near the center of the concentric cutter head.

3. A multi-link cutting tool as described in claim 2 wherein the first and second links each are comprised of two portions, a flat portion connected to the corresponding handle and a curved portion connected to the pivot pin.

4. A multi-link cutting tool as described in claim 2 wherein each handle comprises three portions: a first flat portion at one end of the handle which is connected to the connecting linkage and pivots about the center of the concentric cutter head; a handle grip at the other end of the handle; and a second flat portion between the handle grip and the first flat portion which is stepped with respect to the latter such that the second flat portions of each handle lie in the same plane.

5. A multi-link cutting tool as described in claim 4 wherein the first flat portion of each handle has a groove cut in one surface thereof to accommodate a portion of the connecting link.

6. A multi-link cutting tool as described in claim 5 wherein the first flat portion of each handle has a second groove cut in the surface thereof to accommodate a portion of the connecting link.

7. A multi-link cutting tool as described in claim 1 wherein all four links are positioned between an end of the first and second jaw members away from the cutting edge.

8. A multi-link cutting tool as described in claim 1 wherein the first and second links are longer in length than the third and fourth links.

9. A multi-link cutting tool as described in claim 1 further comprising a fifth link parallel to and spaced apart from the third link and connecting the pivot pin and the first jaw member, and a sixth link parallel to and spaced apart from the fourth link and connecting the pivot pin and the second jaw member.

10. A multi-link cutting tool as described in claim 9 wherein the third link is connected to one surface of the first jaw member and the fifth link is connected to the opposite surface of the first jaw member.

11. A multi-link cutting tool as described in claim 10 wherein the fourth link is connected to one surface of the second jaw member, and the sixth link is connected to the opposite surface of the second jaw member.

12. A multi-link cutting tool as described in claim 11 wherein the third, fourth, fifth and sixth links are oblong plates with a hole through each end.

13. A multi-link cutting tool as described in claim 12 wherein the holes on the third and fifth links are concentric, and the holes on the fourth and sixth links are concentric.

* * * * *